United States Patent [19]

Matsumoto et al.

[11] Patent Number: 4,941,953

[45] Date of Patent: Jul. 17, 1990

[54] DURABLE ELECTRODES HAVING A PLATED TINOR TIN OXIDE INTERMEDIATE LAYER FOR ELECTROLYSIS AND PROCESS FOR PRODUCING THE SAME

[75] Inventors: Yukiei Matsumoto, Kanagawa; Takayuki Shimamune, Tokyo, both of Japan

[73] Assignee: Permelec Electrode Ltd., Kanagawa, Japan

[21] Appl. No.: 361,727

[22] Filed: Jun. 5, 1989

Related U.S. Application Data

[63] Continuation of Ser. No. 52,938, May 22, 1987, abandoned.

[30] Foreign Application Priority Data

May 22, 1986 [JP] Japan ..... 61-116232

[51] Int. Cl.[5] ..... C25D 3/30; C25B 11/06

[52] U.S. Cl. ..... 204/541; 204/561; 204/37.3; 204/38.5; 204/290 F; 427/77; 427/125; 427/123; 427/126.3; 427/126.5; 427/433; 427/437

[58] Field of Search ..... 204/54.1, 56.1, 290 F, 204/290 R, 38.5, 37.3, 35.19; 427/77, 433, 126.3, 125, 437, 123

[56] References Cited

U.S. PATENT DOCUMENTS

| | | | |
|---|---|---|---|
| 3,882,002 | 5/1975 | Cook, Jr. | 204/98 |
| 3,943,042 | 3/1976 | Cook, Jr. | 204/290 F |
| 4,027,055 | 5/1977 | Schneble, Jr. | 427/435 |
| 4,174,410 | 11/1979 | Smith | 424/433 |
| 4,347,107 | 8/1982 | Teichmann et al. | 204/54.1 |

FOREIGN PATENT DOCUMENTS

| | | | |
|---|---|---|---|
| 0004387 | 10/1979 | European Pat. Off. . | |
| 1903806 | 8/1970 | Fed. Rep. of Germany | 204/290 F |
| 0886197 | 1/1962 | United Kingdom | 204/290 F |

OTHER PUBLICATIONS

Patent Abstracts of Japan, vol. 5, No. 195, JP-A-56116892 (Nippon Carlit K.K.), 12-9-81.

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

An electrode for electrolysis is disclosed, comprising an electrode substrate made of a conductive metal having provided thereon an intermediate layer and a coating of an electrode active substance, in which an intermediate layer is formed by tin-plating and is composed of a tin and/or tin oxide. The electrode exhibits high resistance to passivation and excellent durability, and is particularly suitable for use in electrolysis accompanied by oxygen generation and for organic electrolysis.

13 Claims, No Drawings

DURABLE ELECTRODES HAVING A PLATED TINOR TIN OXIDE INTERMEDIATE LAYER FOR ELECTROLYSIS AND PROCESS FOR PRODUCING THE SAME

This is a continuation of application Ser. No. 052,938 filed May 22, 1987, now abandoned.

FIELD OF THE INVENTION

This invention relates to an electrode for electrolysis, and more particularly to an electrode having excellent durability in electrolysis of an aqueous solution accompanied by evolution of oxygen at the anode, and to a process for producing the same.

BACKGROUND OF THE INVENTION

Electrodes for electrolysis using valve metals such as Ti, etc., as a substrate are used as excellent insoluble metal electrodes in a variety of electrochemical fields. In particular, they have been widely put to practical use as chlorine-generating anodes in electrolysis of sodium chloride. Such metals includes Ti as well as Ta, Nb, Zr, Hf, V, Mo, W, etc.

These metal electrodes generally comprise metallic titanium coated with various electrochemically active substances such as platinum group metals or oxides thereof, as typically disclosed, e.g., in U.S. Pat. Nos. 3,632,498 and 3,711,385. They are designed to retain a relatively low chlorine overpotential, for particular use as electrodes for generation of chlorine.

However, when these metal electrodes are used for oxygen generation or as an anode in electrolysis accompanied by oxygen generation, the overpotential at the anode gradually increases. In extreme cases, passivation of the anode occurs, ultimately resulting in failure of continuation of the electrolysis. Such passivation of the anode appears to arise mainly from reaction of the Ti substrate with oxygen from the oxide coating of the electrode itself, or with oxygen from the electrolytic solution diffused and permeated through the electrode coating, to thereby form titanium oxide, that is a poor conductor. Further, since the poor conductor oxide is formed at the interface between the substrate and the electrode coating, it causes the coating to peel off, ultimately destroying the electrode.

Electrolytic processes wherein the anode product is oxygen, or evolution of oxygen occurs as a side reaction, are involved in many industrially important fields, and include electrolysis using a sulfuric acid bath, nitric acid bath, an alkaline bath, etc.; electrolytic winning of Cr, Cu, Zn, etc.; various electroplating processes; electrolysis of a diluted saline solution, sea water, hydrochloric acid, etc.; organic electrolysis; electrolytic production of chlorates; and the like. However, the above-described problems have created problems in the application of the conventional metal electrodes to these fields.

In order to solve such problems, it has been proposed to provide a barrier composed of a Pt-Ir alloy or an oxide of Co, Mn, Pd, Pb, or Pt between the conductive substrate and the electrode coating, in order to prevent passivation of the electrode due to oxygen permeation, as disclosed in Japanese Patent Publication No. 19429/76.

Although such an intermediate barrier is somewhat effective to prevent diffusion and permeation of oxygen during electrolysis, the material composing the barrier per se possesses a considerable electrochemical activity so that it reacts with an electrolyte permeated through the electrode coating to form electrolytic products such as gases on the surface of the barrier. Such electrolytic products physically and chemically impair adhesion of the electrode coating, creating a potential problem that the electrode coating will fall off before the expiration of the life of the electrode coating. In addition, the barrier has a problem of corrosion. Therefore, this proposal is still unsatisfactory for attaining sufficient durability of electrodes.

Another approach is an electrode having a laminated coating comprising a layer of an oxide of Ti, etc., and a layer of a platinum group metal or its oxide, as taught in Japanese Patent Publication No. 48072/74. However, when such an electrode is used for electrolysis involving oxygen evolution, passivation similarly takes place.

In an attempt to overcome these disadvantages, an electrode having an intermediate layer comprising an oxide of Ti or Sn and an oxide of Ta or Nb in which Pt may be dispersed, as disclosed in Japanese Patent Publication Nos. 22074/85 and 22075/85, was previously developed by one of the present inventors along with others. These electrodes exhibit excellent conductivity and durability sufficient for practical application. Nevertheless, since the intermediate layer is formed by thermal decomposition, there remains room for further improvement with respect to denseness of the intermediate layer in order to enhance durability of the electrode.

SUMMARY OF THE INVENTION

One object of this invention is to provide an electrode having passivation resistance and sufficient durability such that it is particularly suitable for use in electrolysis accompanied by oxygen evolution or organic electrolysis.

Another object of this invention is to provide a process for producing such an electrode for electrolysis.

This invention relates to an electrode for electrolysis comprising an electrode substrate made of a conductive metal having provided thereon an intermediate layer and a coating of an electrode active substance, said intermediate layer being formed by tin-plating and comprising at least one of tin and tin oxide.

The intermediate layer according to this invention is corrosion-resistant, electrochemically inactive and has high denseness. It has a function of protecting an electrode substrate, e.g., Ti, against passivation without impairing conductivity of the substrate, combined with a function of providing firm adhesion between the substrate and the electrode coating. Therefore, the electrodes of the present invention can sufficiently withstand use for electrolysis for oxygen generation, electrolysis accompanied by oxygen generation as a side reaction, and for electrolysis of an electrolytic solution containing organic compounds that has been found difficult to carry on with conventional metal electrodes.

DETAILED DESCRIPTION OF THE INVENTION

The electrode substrate which can be used in the present invention includes corrosion-resistant conductive metals, e.g., Ti, Ta, Nb, Zr, etc., and alloys based on these metals. Preferred among them are metallic Ti and Ti-based alloys, e.g., Ti-Ta-Nb, Ti-Pd, etc., that have been commonly employed.

Metallic substrates having been subjected to known surface treatment, such as nitriding treatment, boriding treatment, or carbiding treatment, or having been coated beforehand with an oxide of at least one conductive metal selected from Sn, Ti, Ta, Nb, Zr, Si, Fe, Ge, Bi, Al, Mn, Pb, W, Mo, Sb, V, In, Hf, etc., may also be used as electrode substrates. A thickness of less than about 20 μm is sufficient for the metal oxide coating.

The electrode substrate may have any desired form, such as a plate form, a perforated plate form, a rod form, a net form, and the like.

According to the present invention, an intermediate layer is then formed on the substrate by tin-plating. The Sn intermediate layer formed by plating has higher denseness than that formed by thermal decomposition. Provision of such a dense plating between the substrate and the electrode coating markedly improves durability of electrodes particularly when applied as an anode to electrolysis accompanied by oxygen generation or organic electrolysis.

While the intermediate layer of the invention basically comprises an Sn plating in a metallic state, a part or all of the Sn may be oxidized. Whether the intermediate layer is composed solely of metallic Sn or Sn at least part of which is oxidized is appropriately selected considering the kind of substrate used, the degree of adhesion to an electrode active substance used for coating, and the end use of the electrode.

Plating of Sn intermediate layer can be carried out by any conventional plating technique as long as a dense Sn plating is formed. In particular, electroplating, electroless plating and hot galvanizing (hot dipping) are suitable.

Electroplating is suitable for plating on an electrode substrate made of Ti, Ta, Nb, Zr, etc. It is carried out by bright plating or non-bright plating using an acidic or alkaline plating bath to directly deposit Sn on the substrate as a cathode. When the substrate is previously plated with Fe, an improved Sn plating can be formed.

In cases of using an electrode substrate which has been subjected to the aforesaid surface treatment or an electrode where a conductive metal oxide coating has been previously provided thereon, it is also possible to use electroplating, but the adhesion of an Sn plating can be better assured by electroless plating.

The hot galvanizing technique, in which an electrode substrate is dipped in molten Sn to deposit Sn on the surface of the substrate, may be applied to any of the above-described electrode substrates. The hot galvanizing technique provides a thick Sn plating in a short period of time, while the electroplating and electroless plating techniques are excellent in terms of facilitating thickness control.

The thickness of the Sn plating preferably ranges from 0.5 μm to about 200 μm. A thickness less than 0.5 μm is insufficient for manifestation of the effects of the intermediate layer. On the other hand, if it exceeds 200 μm, there is a fear that the electrolytic voltage may increase due to an increase in resistance.

As noted above, the Sn plating deposited on the electrode substrate shows sufficient effects as an intermediate layer in its original form, but, if desired, a part or all of the Sn may be converted into its oxide by oxidation in an oxidative atmosphere. The oxidation can be carried out easily by heating at a temperature of from 300 to 900° C., usually in air. Alternatively, the oxidation of Sn may be effected afterward, viz., simultaneously with coating of an electrode active substance by thermal decomposition conducted by heating in an oxidative atmosphere.

Conversion of at least a part of Sn to a Sn oxide not only brings about improvements in denseness and durability of the intermediate layer, as well as adhesiveness of the intermediate layer to an electrode active substance to be coated thereon but also prevents Sn from dissolving or evaporating in the form of a chloride due to hydrochloric acid, etc., present in a coating solution of the electrode active substance.

An electrochemically active substance is then coated onto the substrate having an intermediate layer. The substance to be used for electrode coating is preferably selected from metals, metal oxides, and mixtures thereof which have excellent electrochemical characteristics and durability according to the electrolytic reaction to which the electrode is applied. For example, the electrode coating substance suitable for use in electrolysis accompanied by oxygen generation includes platinum group metals, platinum group metal oxides, and mixed oxides of platinum group metal oxides and valve metal oxides. Specific examples of these substances are Pt, Pt-Ir, Pt-$IrO_2$, Ir oxide, Ir oxide-Ru oxide, Ir oxide-Ti oxide, Ir oxide-Ta oxide, Ru oxide, Ti oxide, Ir oxide-Ru oxide-Ta oxide, Ru oxide-Ir oxide-Ti oxide, etc.

The method of forming the electrode coating is not particularly restricted, and any known technique, such as thermal decomposition, plating, electrochemical oxidation, powder sintering, and the like, may be employed. In particular, the thermal decomposition technique as described in U.S. Pat. Nos. 3,632,498 and 3,711,385 is suitable.

The present invention is now illustrated in greater detail by way of the following examples, but it should be understood that the present invention is not limited thereto.

EXAMPLE 1

A commercially available pure titanium plate having a length of 100 mm, a width of 50 mm, and a thickness of 3 mm was degreased with acetone, washed successively with a hot oxalic acid solution and pure water, and dried to prepare an electrode substrate.

The resulting substrate was subjected to electroplating as a cathode using an acidic Sn plating bath having the following formulation at a current density of 2 A/dm$^2$ for a varying period of time to obtain six Sn-plated Ti substrates having a varying plating thickness as shown in Table 1.

Stannous sulfate: 55 g/l
Sulfuric acid: 100 g/l
Cresolsulfonic acid: 100 g/l
Gelatin: 2 g/l
β-Naphthol: 1 g/l
Temperature: 25° C.

After washing each of the Sn-plated Ti substrates with water, each was held in air at 300° C. for 6 hours and then at 550° C. for 24 hours, thereby converting all of the Sn deposit to its oxide to form an intermediate layer.

Onto the intermediate layer was coated $IrO_2$-Pt as an electrode active substance according to the following method to produce an electrode (Sample Nos. 1 to 6).

A butanol solution containing iridium chloride (50 g/l Ir) and a butanol solution containing platinum chloride (50 g/l Pt) were prepared, and the two solutions were mixed in such a mixing ratio as to have an Ir/Pt molar ratio of 2/1 to prepare a coating solution. The resulting coating solution was coated with a brush on the above-obtained electrode substrate having an intermediate layer thereon, dried, and sintered at a temperature of 550° C. for 10 minutes. The thus formed coating was found to contain 0.1 mg/cm$^2$ of the platinum group metals. For comparison, a Ti electrode was produced in the same manner as above, except that the intermediate layer was not provided (Sample No. 7).

The durability of the resulting electrodes was evaluated by performing electrolysis using each of the resulting electrodes as an anode and a platinum plate as a cathode in a 1M sulfuric acid aqueous solution at a temperature of 50° C. and a current density of 1 A/cm$^2$. The time that elapsed until the electrolytic cell voltage reached 10 V was taken as durability. The results obtained are shown in Table 1. It can be seen from Table 1 that the duration of the electrodes can be significantly prolonged by forming the intermediate layer according to the present invention.

TABLE 1

| Sample No. | Electrode substrate | Sn plating thickness (μm) | Electrode coating | Durability (hr) |
|---|---|---|---|---|
| 1 | Ti | 1 | $IrO_2$-Pt | 16.3 |
| 2 | " | 12 | " | 28.7 |
| 3 | " | 23 | " | 40.1 |
| 4 | " | 56 | " | 49.4 |
| 5 | " | 92 | " | 53.4 |
| 6 | " | 186 | " | 35.6 |
| 7 | " | — | " | 9.0 |

EXAMPLE 2

A Ti plate, a Ti-3Ta-3Nb alloy plate, a Ti plate subjected to a nitriding treatment so as to have a nitride layer of about 3 μm in thickness (Sample Nos. 12 and 16), and a Ti or Ti alloy plate having a metal oxide shown in Table 2 coated thereon, each having the same size as used in Example 1, were used as an electrode substrate. The oxide coating on the Ti or Ti alloy plate (Sample Nos. 9, 11, and 14) was formed by applying a coating solution of a metal chloride in 35 wt % hydrochloric acid having a metal ion concentration of 0.1 mol/l on the substrate with a brush, drying, and sintering the coating at 550° C. for 10 minutes, and repeating these procedures until a desired thickness was obtained. Each of these substrates was dipped in molten Sn heated at 350° C., removed and cooled to form an Sn-plated intermediate layer. The Sn-plated electrode substrate was then coated with an electrode active substance shown in Table 2 to produce an electrode (Sample Nos. 8 to 12). For comparison, electrodes were produced in the same manner as for Sample Nos. 8 to 12, except that a Sn intermediate layer was not formed (Sample Nos. 13 to 16).

Each of the resulting electrodes was evaluated in the same manner as in Example 1, and the results obtained are shown in Table 2.

TABLE 2

| Sample No. | Electrode substrate: Substrate | Electrode substrate: Oxide coating (thickness: μm) | Sn plating thickness (μm) | Electrode coating | Durability (hr) |
|---|---|---|---|---|---|
| 8 | Ti | — | 21 | $IrO_2$ | 52.3 |
| 9 | " | $Nb_2O_5$ (1) | 68 | " | 121.1 |
| 10 | Ti—3Ta—3Nb | — | 51 | " | 52.6 |
| 11 | " | $Nb_2O_5$—$SnO_2$ (1) | 45 | " | 101.2 |
| 12 | TiN/Ti | — | 97 | Pt | 32.8 |
| 13 | Ti | — | — | $IrO_2$ | 9.5 |
| 14 | " | $Nb_2O_5$ (1) | — | " | 17.6 |
| 15 | Ti—3Ta—3Nb | — | — | " | 7.1 |
| 16 | TiN/Ti | — | — | Pt | 2.2 |

EXAMPLE 3

Tin oxide was coated on a Ti plate to a thickness of 5 μm in the same manner as described in Example 2 to prepare an oxide-coated Ti substrate. The substrate was subjected to electroplating using an alkaline Sn plating bath having the following formulation at a current density of 1 A/dm$^2$ to form a Sn intermediate layer having a thickness of 20 μm.

Sodium stannate: 100 g/l
Sodium hydroxide: 10 g/l
Sodium acetate: 15 g/l
Temperature: 70° C.

Pt-$IrO_2$-$HfO_2$-$TiO_2$ (metal molar ratio = 1/2/2/5) was coated as an electrode active substance by thermal decomposition onto the Sn-plated substrate in the same manner as described in Example 1 to obtain an electrode. For comparison, an electrode was produced in the same manner as above, except that a Sn intermediate layer was not formed.

When each of the electrodes was evaluated in the same manner as in Example 1, the durability of the electrode according to the present invention was 48.1 hours, whereas that of the comparative electrode was 7.6 hours.

EXAMPLE 4

A Ti plate subjected to etching with an oxalic acid solution was coated with $SnO_2$ to a thickness of about 1 μm by thermal decomposition. The $SnO_2$-coated substrate was then dipped in a bath having the following formulation for 30 minutes to deposit Sn to a thickness of about 1 μm as an intermediate layer.

Stannous chloride: 120 g/l
Hydrochloric acid: 100 ml/l
Thiourea: 200 g/l
Sodium hypophosphate: 70 g/l
Tartaric acid: 90 g/l
Temperature: 50° C.

The Sn intermediate layer was sintered in air at 550° C. for 5 hours to convert the Sn to Sn oxide. A solution of Ru, Ge, and Sb (molar ratio = 10/35/1) in hydrochloric acid was then coated thereon, followed by sintering at 550° C. for 10 minutes. The coating and sintering procedures were repeated to form an electrode active substance coating composed of $RuO_2$-$GeO_2$-$Sb_2O_3$. The resulting electrode was evaluated in the same manner as in Example 1. As a result, it was found that the durability of the electrode was 16 times longer than that of a comparative electrode which was produced in the same manner except that no intermediate layer was provided.

EXAMPLE 5

A Sn intermediate layer was formed on each of electrode substrates shown in Table 3 by electroplating in the same manner as in Example 1. The Sn-plated substrate was then coated with an electrode active substance as shown in Table 3 to produce an electrode (Sample Nos. 17 to 24). The resulting samples were evaluated for durability in the same manner as in Example 1. The results obtained are shown in Table 3, which are expressed in terms of the ratio of the durability of the electrode to that of the corresponding comparative electrode produced in the same manner but without an intermediate layer.

TABLE 3

| Sample No. | Electrode substrate: Sub-strate | Electrode substrate: Coating | Sn plating thickness (μm) | Electrode coating | Durability (ratio) |
|---|---|---|---|---|---|
| 17 | Ti | TiN | 38 | $IrO_2$ | 7.1/1 |
| 18 | " | — | 16 | Pt | 15.4/1 |
| 19 | " | — | 52 | $RuO_2$—$IrO_2$—$SnO_2$ | 10.0/1 |
| 20 | " | — | 30 | PdO—$Ta_2O_5$—$In_2O_3$ | 20.3/1 |
| 21 | " | $GeO_2$ | 26 | Pt—$RuO_2$—$IrO_2$—$SnO_2$—$Sb_2O_3$ | 17.8/1 |
| 22 | " | $Fe_2O_3$ | 7 | Pt—$Nb_2O_5$ | 11.0/1 |
| 23 | " | — | 28 | Pt—Ir | 17.3/1 |
| 24 | " | $SiO_2$—$Nb_2O_5$ | 50 | $IrO_2$—$Co_3O_4$ | 4.6/1 |

It can be seen from the results of Table 3 that the durability of electrodes can be extended several times by providing an intermediate layer according to the present invention.

EXAMPLE 6

Each of the electrode substrates shown in Table 4 was subjected to electroplating with Sn using an alkaline plating bath in the same manner as in Example 3. The Sn-plated substrate was then coated with $IrO_2$ as an electrode active substance to a thickness of 1 mg/cm$^2$ to prepare an electrode.

In order to evaluate durability of the resulting electrode, organic electrolysis was performed using the electrode as an anode, a platinum plate as a cathode, and an electrolytic solution comprising 1 mol/l of acetonitrile and 1 mol/l of sulfuric acid at a temperature of 40° C. and at a current density of 1 A/cm$^2$. The time period required for the electrolytic cell voltage to reach 10 V was determined and compared with that of a comparative electrode prepared in the same manner as above except that no Sn plating was formed. The results obtained are shown in Table 4.

TABLE 4

| Sample No. | Electrode substrate: Sub-strate | Electrode substrate: Oxide coating (thickness: μm) | Sn plating thickness (μm) | Electrode coating | Durability (hr) |
|---|---|---|---|---|---|
| 25 | Ti | — | 5 | $IrO_2$ | 219.8 |
| 26 | " | $SnO_2$ (5) | 8 | " | 382.5 |
| 27 | " | $Nb_2O_5$ (3) | 12 | " | 321.8 |
| 28 | " | — | — | " | 26.4 |

It is apparent from the results of Table 4 that the electrodes according to the present invention in which an Sn intermediate layer is provided exhibit remarkably increased durability when applied to organic electrolysis over the comparative electrode without an intermediate layer.

As described above, according to the present invention in which an intermediate layer formed by tin-plating and composed of at least one of Sn and its oxide is provided between an electrode substrate and an electrode active substance coating, passivation resistance and durability of electrodes can be greatly improved. Therefore, the durable electrodes of the present invention are particularly suitable for use in electrolysis accompanied by oxygen generation and for organic electrolysis.

While the invention has been described in detail and with reference to specific embodiments thereof, it will be apparent to one skilled in the art that various changes and modifications can be made therein without departing from the spirit and scope thereof.

What is claimed is:

1. An electrode for electrolysis comprising an electrode substrate made of a conductive metal having provided thereon an intermediate layer and a coating of an electrode active substance, said intermediate layer being a dense, non-porous layer and formed by tin-plating and consisting of at least one of tin and tin oxide.

2. An electrode for electrolysis as in claim 1, wherein said electrode substrate is selected from the group consisting of Ti, Ta, Nb, Zr, and an alloy of these metals.

3. An electrode for electrolysis as in claim 2, wherein said electrode substrate is Ti or a Ti-based alloy.

4. An electrode for electrolysis as in claim 1, wherein said electrode substrate is a conductive metal having been coated with a conductive metal oxide.

5. An electrode for electrolysis as in claim 1, wherein said electrode substrate is a conductive metal having been subjected to nitriding, boriding, or carbiding treatment.

6. An electrode for electrolysis as in claim 1, wherein said electrode active substance contains a platinum group metal or an oxide thereof.

7. A process for producing an electrode for electrolysis which comprises plating tin on an electrode substrate made of a conductive metal to form a dense, non-porous intermediate layer consisting of tin, and coating an electrode active substance thereon.

8. A process for producing an electrode for electrolysis as in claim 7, wherein said process further includes oxidizing the tin plating to convert at least a part of said tin to tin oxide.

9. A process as in claim 8, wherein said oxidizing of the tin plating is carried out by heating at a temperature of from 300 ° to 900° C. in an oxidative atmosphere.

10. A process as in claim 7, wherein said electrode substrate is selected from the group consisting of Ti, Ta, Nb, Zr, and an alloy of these metals, a conductive metal having been coated with a conductive metal oxide, or a conductive metal having been subjected to nitriding, boriding, or carbiding treatment.

11. A process as in claim 10, wherein said electrode substrate is Ti or a Ti-based alloy.

12. A process as in claim 7, wherein said plating of tin is carried out by electroplating, electroless plating, or hot galvanizing.

13. A process as in claim 7, wherein said coating of the electrode active substance is carried out by thermal decomposition.

* * * * *